US008132297B2

(12) United States Patent
Breuer et al.

(10) Patent No.: US 8,132,297 B2
(45) Date of Patent: Mar. 13, 2012

(54) APPARATUS ON A FLAT CARD OR ROLLER CARD HAVING A CYLINDER AND AT LEAST ONE DOFFER

(75) Inventors: Achim Breuer, Aachen (DE); Christoph Farber, Korschenbroich (DE); Jurgen Marz, Dusseldorf (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 218 days.

(21) Appl. No.: 12/466,813

(22) Filed: May 15, 2009

(65) Prior Publication Data

US 2009/0293232 A1 Dec. 3, 2009

(30) Foreign Application Priority Data

May 31, 2008 (DE) ..... 10 2008 027 355

(51) Int. Cl.
*D01G 15/46* (2006.01)

(52) U.S. Cl. ..... 19/106 R

(58) Field of Classification Search ..... 19/106 R, 19/114; D15/78

See application file for complete search history.

(56) References Cited

U.S. PATENT DOCUMENTS

| | | | | |
|---|---|---|---|---|
| 6,101,680 | A * | 8/2000 | Naf et al. | 19/102 |
| 6,219,885 | B1 * | 4/2001 | Faas et al. | 19/98 |
| 2006/0019809 | A1 * | 1/2006 | Schlichter et al. | 492/50 |

FOREIGN PATENT DOCUMENTS

| | | | |
|---|---|---|---|
| CN | 2221034 | | 2/1996 |
| CN | 201033812 | | 3/2008 |
| DE | 1 685 615 | | 8/1971 |
| DE | 2226914 | A * | 12/1973 |
| DE | 28 03 467 | A1 | 8/1979 |
| DE | 102005040249 | A1 | 3/2007 |
| EP | 0 314 310 | | 5/1989 |
| EP | 0 866 153 | B2 | 7/2002 |
| GB | 236547 | | 3/1926 |
| GB | 1155605 | | 6/1969 |
| JP | 62062919 | A | 3/1987 |
| WO | WO-2007/022659 | | 3/2007 |

OTHER PUBLICATIONS

German Search Report, issued in a counterpart application and English-language translation.
British Search Report dated Aug. 28, 2009, issued in related British Application No. GB0908618.2.

* cited by examiner

*Primary Examiner* — Shaun R Hurley
(74) *Attorney, Agent, or Firm* — Venable LLP; Robert Kinberg; Leigh D. Thelen

(57) ABSTRACT

In an apparatus on a carding machine having a cylinder and at least one doffer, in which the cylinder and the doffer each have an all-steel clothing having saw teeth, the clothing on the cylinder and the clothing on the doffer each have a point density per square inch (ppsi). For achieving increased production rate with the same quality or improved quality with the same production rate, the clothing on the doffer has a point density of at least 400 ppsi, and the ratio between the point density of the clothing of the cylinder and the point density of the clothing of the doffer influences the proportion of the fiber mass that is transferred from the cylinder to the doffer per revolution of the cylinder in the sense of a higher production rate or higher quality of the card.

15 Claims, 2 Drawing Sheets

APPARATUS ON A FLAT CARD OR ROLLER CARD HAVING A CYLINDER AND AT LEAST ONE DOFFER

CROSS REFERENCE TO RELATED APPLICATION

This application claims priority from German Patent Application No. 10 2008 027 355.4 dated May 31, 2008, the entire disclosure of which is incorporated herein by reference.

BACKGROUND OF THE INVENTION

The invention relates to an arrangement on a flat card or roller card having a cylinder and at least one doffer, especially for processing cotton and/or synthetic fibres, in which the cylinder and the doffer each have an all-steel clothing having saw teeth.

A clothing on the cylinder and a clothing on the doffer of a carding machine each have a point density per square inch (ppsi). The number of points per unit area (ppsi) has a not insignificant effect on the carding operation. The point counts of the cylinder and doffer clothings must be matched to one another. It is generally the case that the higher the point count, the better is the carding operation up to a certain optimum. That optimum is highly material-dependent. Fine fibres have to be processed with a larger number of points, because more fibres are present for the same material throughput.

JP 62-62919 discloses the provision in a carding machine of a point density of 864 per $(25.4\ \text{mm})^2$ for the cylinder clothing and of 359 per $(25.4\ \text{mm})^2$ for the doffer. The production rate of the carding machine is insufficient with a ratio of 2.40 between the point count of the cylinder and the point count of the doffer.

SUMMARY OF THE INVENTION

It is an aim of the invention to provide an apparatus of the kind mentioned at the beginning which avoids or mitigates the known disadvantages and which, in particular, makes it possible to achieve a considerable increase in production rate or/and an improvement in the quality of the carding machine, for example an increase in production rate with the same quality or an improvement in quality with the same production rate.

The invention provides an apparatus on a carding machine having a cylinder and at least one doffer in which:

the cylinder has a saw-tooth clothing having a first point density; and the doffer has a saw-tooth clothing having a second point density;

wherein the point density of the clothing on the doffer is at least 400 ppsi, and the ratio between the point density of the clothing of the cylinder and the point density of the clothing of the doffer is selected to influence the proportion of the fibre mass that, in use, is transferred from the cylinder to the doffer per revolution of the cylinder for increasing production rate or production quality.

Because, with a point count of at least 400 ppsi for the doffer clothing, according to the invention the ratio of the point count of the cylinder to the point count of the doffer can be matched to the proportion of the fibre mass transferred to the doffer per revolution of the cylinder, it is possible to achieve a higher production rate or higher quality of the carding machine. A further particular advantage is that an increase in production rate with the same quality or an improvement in quality with the same production rate is achievable.

The carding machine may, especially, be a flat card or roller card. Preferably, the carding machine is for processing cotton and/or synthetic fibres. Preferably, the clothing of the cylinder and/or the clothing of the doffer is all-steel clothing.

In some embodiments, the ratio of the point density of the cylinder clothing to the point density of the doffer is so selected that the proportion of the fibre mass transferred from the cylinder is increased. In one such embodiment, the sliver weight at the output of the carding machine may be increased while the delivery speed remains the same. In another such embodiment, the delivery speed at the output of the carding machine may be increased while the sliver weight remains the same.

Preferably, the transfer factor (that is, the percentage of the fibre mass that is transferred to the doffer on each revolution of the cylinder) can be altered by altering the ratio between the point density on the cylinder and the point density on the doffer.

In a preferred embodiment, the ratio of the point counts per square inch (ppsi) of the cylinder and the doffer is smaller than the product of the point count of the cylinder and a factor V1, the factor V1 being less than $2.2\times10^{-3}$, preferably less than $2.08\times10^{-3}$.

In one illustrative embodiment, the ratio between the point count of the cylinder (ppsi) and the point count (ppsi) of the doffer is less than 1 in the range of a cylinder point count of from 450 to 550 ppsi. In a second illustrative embodiment, the ratio between the point count of the cylinder (ppsi) and the point count (ppsi) of the doffer is less than 1.23 in the range of cylinder point count of from 551 to 650. In a third illustrative embodiment, the ratio between the point count of the cylinder (ppsi) and the point count (ppsi) of the doffer is less than 1.46 in the range of a cylinder point count of from 651 to 750. In a fourth illustrative embodiment, the ratio between the point count of the cylinder (ppsi) and the point count (ppsi) of the doffer is less than 1.68 in the range of a cylinder point count of from 751 to 850. In a fifth illustrative embodiment, the ratio between the point count of the cylinder (ppsi) and the point count (ppsi) of the doffer is less than 1.91 in the range of a cylinder point count of from 851 to 950. In a sixth illustrative embodiment, the ratio between the point count of the cylinder (ppsi) and the point count (ppsi) of the doffer is less than 2.13 in the range of a cylinder point count of from 951 to 1050.

In certain embodiments, the doffer clothing has a foot width of less than 0.8 mm, preferably less than 0.7 mm, especially less than 0.6 mm. In further embodiments, the doffer clothing has a spacing of less than 1.7 mm, preferably less than 1.6 mm, especially less than 1.5 mm.

In certain embodiments, the doffer clothing is so configured and dimensioned that the product of the point count and the front angle is greater than $1.32\times10^4$. In an illustrative embodiment, the penetration depth (tooth depth $h_6$) is less than 1.8 mm, preferably less than 1.3 mm. By way of illustration, the filling height (blade height $h_3$) maybe less than 2.7 mm, preferably less than 2.2 mm, especially less than 1.7 mm.

The invention further provides an apparatus on a flat card or roller card having a cylinder and at least one doffer, especially for processing cotton and/or synthetic fibres, in which the cylinder and the doffer each have an all-steel clothing having saw teeth, the clothing on the cylinder and the clothing on the doffer each having a point density per square inch (ppsi), in which the clothing on the doffer has a point density of at least 400 ppsi, and the ratio between the point density (ppsi) of the clothing of the cylinder and the point density (ppsi) of the clothing of the doffer influences the proportion of the fibre mass that is transferred from the cylinder to the doffer per revolution of the cylinder in terms of a higher production rate or higher quality of the flat card or roller card.

The invention also provides a saw-tooth wire for a clothing for a cylinder and doffer of an apparatus according to the invention, and a roller, especially a cylinder and a doffer, for use in the apparatus according to the invention. Furthermore, the invention provides a carding machine comprising an apparatus according to the invention. The carding machine may have a cylinder and, if desired, two doffers each having a clothing according the invention.

DETAILED DESCRIPTION OF CERTAIN PREFERRED EMBODIMENTS

Figure 1:
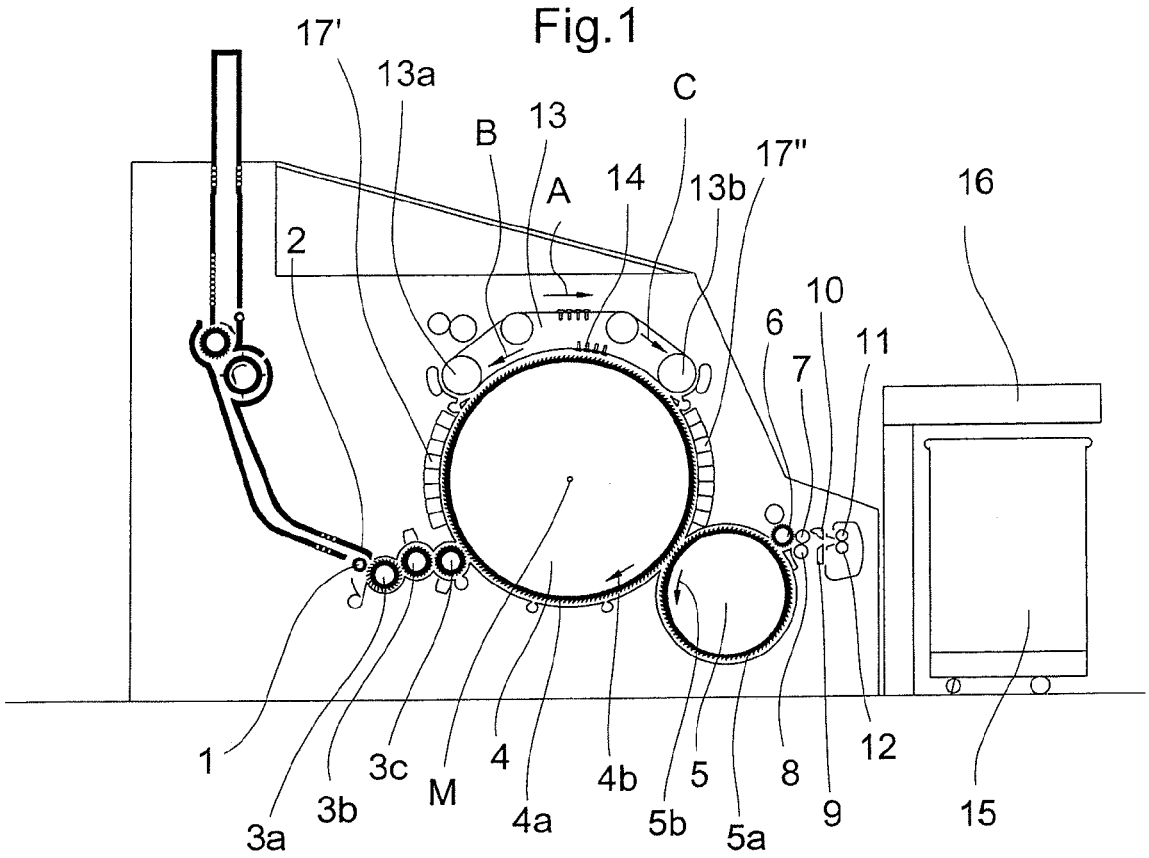
FIG. 1 is a diagrammatic side view of a flat card having a cylinder and a doffer, each having saw-tooth wire clothing.

With reference to FIG. 1, a flat card, e.g. a TC 07 flat card of the kind made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web guide element 9, web funnel 10, delivery rollers 11, 12, revolving card top 13 with card top guide rollers 13*a*, 13*b* and flats 14, can 15 and can coiler 16. The directions of rotation of the rollers are indicated by curved arrows. Reference letter M denotes the centre point (axis) of the cylinder 4. Reference numeral 4*a* indicates the clothing and reference numeral 4*b* indicates the direction of rotation of the cylinder 4. Reference numeral 5*a* indicates the clothing and reference numeral 5*b* indicates the direction of rotation of the doffer 5. Reference letter B denotes the direction of rotation of the revolving card top 13 in the carding position and reference letter C denotes the return transport direction of the flats 14. Fixed cover elements or working elements, for example fixed carding elements 17', are arranged between the licker-in 3*c* and the rear card top guide roller 13*a*, and fixed cover elements or working elements, for example fixed carding elements 17", are arranged between the front card top guide roller 13*b* and the doffer 5. Arrow A indicates the working direction. The curved arrows inside the rollers indicate the directions of rotation of the rollers.

Figure 2:
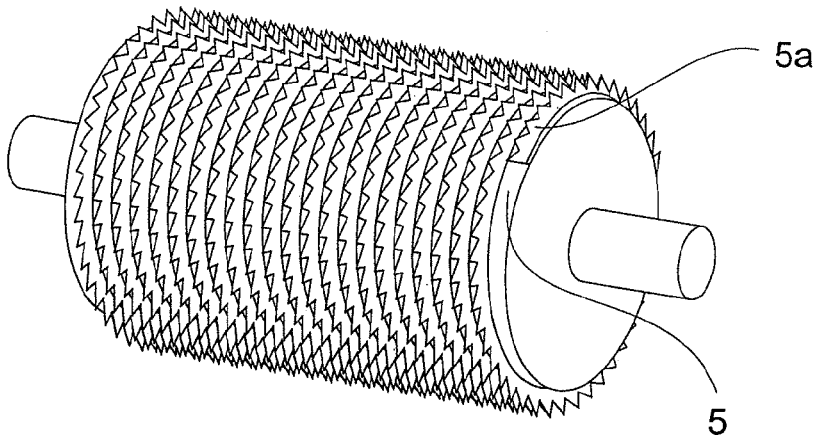
FIG. 2 is a perspective view of the doffer of the flat card having saw-tooth all-steel clothing made of saw-tooth wire.

With reference to FIG. 2, the doffer 5 has been spirally wound with an endless saw-tooth wire, forming a saw-tooth all-steel clothing 5*a*.

The cylinder 4 (see FIG. 1), in analogous manner to that shown in FIG. 2 for the doffer 5 with the doffer clothing 5*a*, has been correspondingly spirally wound with a saw-tooth wire, forming a saw-tooth all-steel clothing 4*a*.

Figure 3:
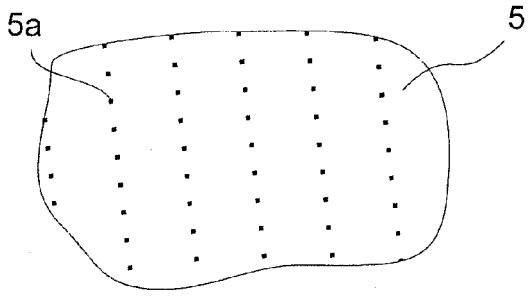
FIG. 3 is a plan view of an enlarged detail from the clothing on the doffer according to FIG. 2, the points of the clothing being shown in diagrammatic form.

Referring to FIG. 3, which shows an enlarged detail from a plan view of the clothing 5*a* according to FIG. 2, the tooth tips (see FIG. 5*a*) are arranged one after the other in the direction of rotation 5*b* of the doffer 5. Adjacent rows of tooth tips have a channel between them. The point count per square inch is indicated by ppsi (points per square inch).

Figure 4:
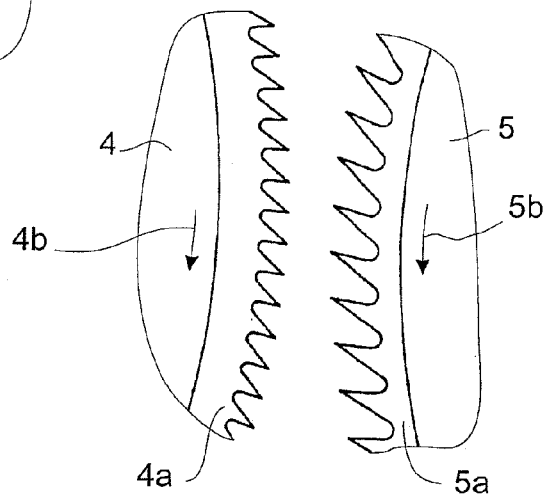
FIG. 4 shows in diagrammatic form the positioning of the clothing between the cylinder and the doffer.

With reference to FIG. 4, the clothing 4*a* on the cylinder 4 is arranged in the carding position and the clothing 5*a* of the doffer 5 is arranged in the doffing position.

Figure 5A:
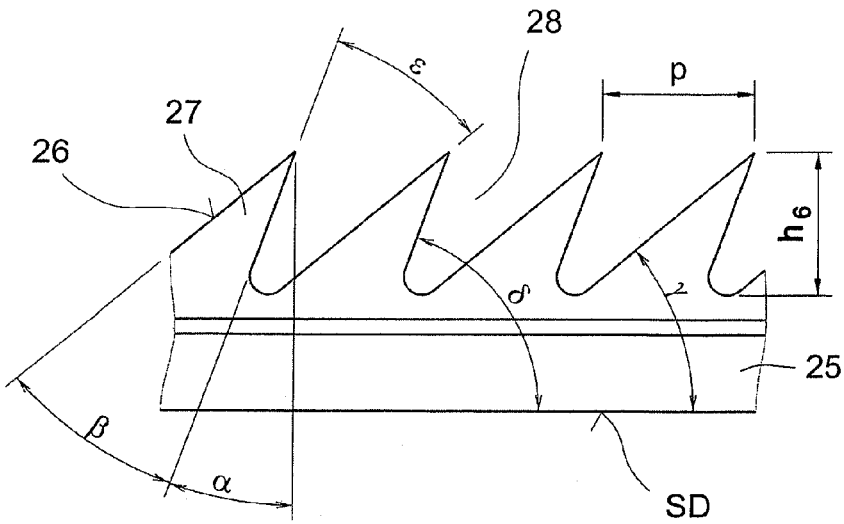
FIGS. 5*a*, 5*b* are a side view (FIG. 5*a*) and a sectional view (FIG. 5*b*) of a saw-tooth wire.
Figure 5B:
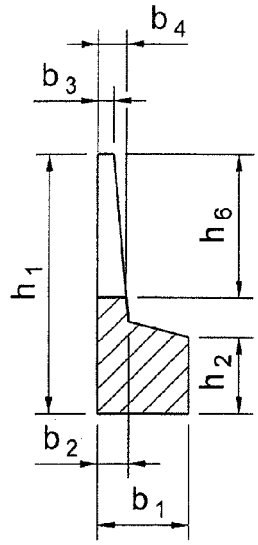

FIGS. 5*a*, 5*b* show a side view and a sectional view, respectively, of a saw-tooth wire SD, which is formed in one piece from a foot 25 and a blade 26, having teeth between which there are gullets 28.

The following are indicated in FIG. 5*a*:

| Symbol | Term | Definition |
|---|---|---|
| $\alpha$ | Front angle | Angle between the front face and the vertical axis relative to the wire base |
| $\beta$ | Wedge angle | Angle between the front angle $\delta$ and the back angle $\gamma$ of the tooth |
| $\gamma$ | Back angle | Angle between the back face and the wire base |
| $\delta$ | Front angle | Angle between the front face and the wire base |
| $\epsilon$ | Opening angle | Corresponds to the wedge angle ($\epsilon = \beta$) |
| $h_6$ | Tooth depth | Depth of the gullet cut-out measured from the tooth tip |
| p | Tooth spacing | Distance between two successive tooth tips, measured with the wire straightened out |

The following are indicated in FIG. 5*b*:

| Symbol | Term | Definition |
|---|---|---|
| $h_1$ | Total height of the wire | Distance from the base to the tip of the wire |
| $h_2$ | Foot height | Height of the foot measured from the base |
| $b_1$ | Foot width | Width of the foot at the base of the wire |
| $b_2$ | Blade width at the foot | Width of the blade, measured at the foot |
| $b_3$ | Blade width at the tip | Width of the blade, measured at the tip |

$h_3$ denotes the blade height (filling height) which is obtained from the difference $h_1-h_2$. $b_4$ denotes the blade width at the point of the deepest gullet cut-out.

An example of a saw-tooth wire SD for the clothing 4*a* of a cylinder 4 of the TC 07 flat card which is produced by Trützschler Card Clothing GmbH, D-75387 Neubulach:

T 20.40.040.0950.05/X 950 ppsi $\alpha$=40°

$b_1$=0.4 mm

In one embodiment according to the invention in the case of that illustrative cylinder clothing the doffer 5 may be provided with a clothing 5*a* having a point count of 500 ppsi.

If the ratio between the point density of the clothing 4*a* of the cylinder 4 and the point density of the clothing 5*a* of the doffer 5 is chosen in accordance with the invention as claimed herein then—as a result of the increased point count of the doffer clothing 5*a*, which results in more fibre material being removed from the cylinder clothing 4*a*—there is less fibre material in the clothing 4*a* of the cylinder 4, so that quality is improved.

If, as in certain preferred embodiment of the invention, the fibre mass in the clothing 4*a* of the cylinder 4 is increased, the production rate of the carding machine is increased as a result.

The increase in the fibre mass in the cylinder clothing 4*a* is effected by increased supply (feed) by the feed roller 1.

The transfer factor is a measure of the percentage of the fibre mass located on the cylinder 4 that is transferred to the doffer 5 on each revolution of the cylinder 4. The transfer factor can be altered by altering the ratio between the point density on the cylinder and the point density on the doffer. In a preferred embodiment, the ratio of the point count of the cylinder to the point count of the doffer is smaller than the product of the point count of the cylinder and a factor V1, the factor V1 being less than $2.2\times10^{-3}$. That enables a favourable transfer ratio to be achieved.

Although the foregoing invention has been described in detail by way of illustration and example for purposes of understanding, it will be obvious that changes and modifications may be practised within the scope of the appended claims.

What we claim is:

1. An apparatus on a carding machine, for processing a fibre mass into sliver, comprising:

a cylinder including a saw-tooth clothing having a first point density; and a doffer including a saw-tooth clothing having a second point density;

wherein the point density of the clothing on the doffer is at least 400 ppsi, and a transfer factor representing a proportion of fibre mass transferred from the cylinder to the doffer per revolution is alterable by a selection of a ratio between the point density of the clothing of the cylinder and the point density of the clothing of the doffer, and wherein the ratio of the number of points per square inch (ppsi) of the cylinder and the doffer is smaller than the product of the number of points per square inch of the cylinder and a factor V1, the factor V1 being less than $2.2\times10^{-3}$.

2. An apparatus according to claim 1, in which the factor V1 is less than $2.08\times10^{-3}$.

3. An apparatus according to claim 1, in which the ratio between the number of points per square inch of the cylinder and the number of point per square inch of the doffer is less than 1 in the range of a cylinder point count of from 450 to 550 ppsi.

4. An apparatus according to claim 1, in which the ratio between the number of points per square inch of the cylinder and the number of points per square inch of the doffer is less than 1.23 in the range of a cylinder point count of from 551 to 650.

5. An apparatus according to claim 1, in which the ratio between the number of points per square inch of the cylinder and the number of points per square inch of the doffer is less than 1.46 in the range of a cylinder point count of from 651 to 750.

6. An apparatus according to claim 1, in which the ratio between the number of points per square inch of the cylinder and the number of points per square inch of the doffer is less than 1.68 in the range of a cylinder point count of from 751 to 850.

7. An apparatus according to claim 1, in which the ratio between the number of points per square inch of the cylinder and the number of points per square inch of the doffer is less than 1.91 in the range of a cylinder point count of from 851 to 950.

8. An apparatus according to claim 1, in which the ratio between the number of points per square inch of the cylinder and the number of points per square inch of the doffer is less than 2.13 in the range of a cylinder point count of from 951 to 1050.

9. An apparatus according to claim 1, in which the doffer clothing has a foot width of less than 0.8 mm.

10. An apparatus according to claim 1, in which the doffer clothing has a spacing of less than 1.7 mm.

11. An apparatus according to claim 1, in which, in the doffer clothing, the product of the number of points per square inch and the front angle is greater than $1.32\times10^{4}$.

12. An apparatus according to claim 1, in which the tooth depth is less than 1.8 mm.

13. An apparatus according to claim 1, in which the blade height is less than 2.7 mm.

14. An apparatus on a flat card or roller card for processing cotton and/or synthetic fibres into sliver, comprising:

a cylinder and at least one doffer, in which the cylinder and the doffer each have an all-steel clothing having saw teeth, the clothing on the cylinder and the clothing on the doffer each having a point density per square inch (ppsi), wherein the clothing on the doffer has a point density of at least 400 ppsi, and a transfer factor representing a proportion of fibre mass transferred from the cylinder to the doffer per revolution is alterable by a selection of a ratio between the point density of the clothing of the cylinder and the point density of the clothing of the doffer, and wherein the ratio of the number of points per square inch (ppsi) of the cylinder and the doffer is smaller than the product of the number of points per square inch of the cylinder and a factor V1, the factor V1 being less than $2.2\times10^{-3}$.

15. A carding machine having a cylinder and at least one doffer, each having a clothing with a respective point density per square inch (ppsi), wherein the doffer point density is at least 400 ppsi and a transfer factor representing a proportion of fibre mass transferred from the cylinder to the doffer per revolution is alterable by a selection of a ratio between the cylinder point density and the doffer point density, and wherein the ratio of the number of points per square inch (ppsi) of the cylinder and the doffer is smaller than the product of the number of points per square inch of the cylinder and a factor V1, the factor V1 being less than $2.2\times10^{-3}$.

* * * * *